US009540079B2

(12) United States Patent
Wilbur

(10) Patent No.: US 9,540,079 B2
(45) **Date of Patent: *Jan. 10, 2017**

(54) DUAL DIRECTIONAL SURFBOARD

(71) Applicant: Joshua Paul Wilbur, Santa Cruz, CA (US)

(72) Inventor: Joshua Paul Wilbur, Santa Cruz, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/658,956

(22) Filed: Oct. 24, 2012

(65) Prior Publication Data

US 2013/0102210 A1 Apr. 25, 2013

Related U.S. Application Data

(60) Provisional application No. 61/550,988, filed on Oct. 25, 2011.

(51) Int. Cl.
*B63B 35/79* (2006.01)

(52) U.S. Cl.
CPC ..... *B63B 35/79* (2013.01); *B63B 35/7926* (2013.01)

(58) Field of Classification Search
CPC ... B63B 35/7906; B63B 35/79; B63B 35/7903
USPC ..... 441/74, 79; D21/769
See application file for complete search history.

(56) References Cited

U.S. PATENT DOCUMENTS

| | | | | |
|---|---|---|---|---|
| 3,337,886 | A * | 8/1967 | Ekstrom | 441/74 |
| 4,592,734 | A * | 6/1986 | Metiver | 441/74 |
| 5,152,705 | A * | 10/1992 | Rock | 441/74 |
| 6,461,210 | B2 * | 10/2002 | Lorenzo | 441/68 |
| 6,935,909 | B2 * | 8/2005 | Mann | 441/65 |
| 7,390,234 | B2 * | 6/2008 | Peach | 441/74 |
| D663,372 | S * | 7/2012 | Wilbur | D21/769 |
| D686,682 | S * | 7/2013 | Wilbur | D21/769 |
| 2005/0042955 | A1 * | 2/2005 | Redmon | 441/79 |

* cited by examiner

*Primary Examiner* — Edwin Swinehart

(57) ABSTRACT

A dual-directional surfboard comprising a first end, and a second end such that either of said first end or said second end acts as a tail.

20 Claims, 7 Drawing Sheets

DUAL DIRECTIONAL SURFBOARD

CROSS-REFERENCE TO RELATED APPLICATIONS

This application claims the benefit of the filing date and claims U.S. provisional patent application 61/550,988, filed on Oct. 25, 2011, by Joshua Paul Wilbur, entitled "Dual Directional Surfboard".

BACKGROUND OF THE INVENTION

Typically, surfboards travel in a single direction. Moreover, they include a nose (which does not include fins) that is generally pointed and curved upwards to work with the contour of the wave and a tail portion in the back of the board that includes fins.

BRIEF SUMMARY OF INVENTION

A dual-directional surfboard comprising a first end, and a second end such that either of said first end or said second end acts as a leading or trailing end.

The drawings referred to in this description should be understood as not being drawn to scale except if specifically noted.

DETAILED DESCRIPTION OF THE INVENTION

Reference will now be made in detail to embodiments of the present technology, examples of which are illustrated in the accompanying drawings. While the technology will be described in conjunction with various embodiment(s), it will be understood that they are not intended to limit the present technology to these embodiments. On the contrary, the present technology is intended to cover alternatives, modifications and equivalents, which may be included within the spirit and scope of the various embodiments as defined by the appended claims.

Furthermore, in the following description of embodiments, numerous specific details are set forth in order to provide a thorough understanding of the present technology. However, the present technology may be practiced without these specific details. In other instances, well known methods, procedures, and components have not been described in detail as not to unnecessarily obscure aspects of the present embodiments.

Figure 1A:
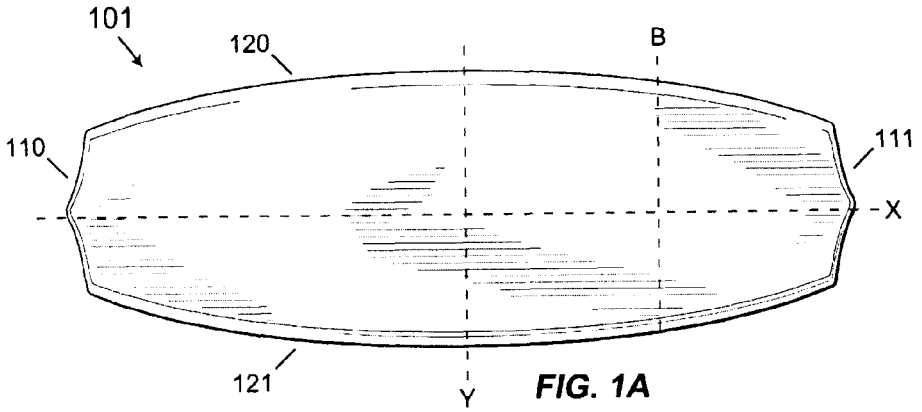
FIGS. 1A-12 illustrate various embodiments of a dual directional surfboard.
Figure 1B:
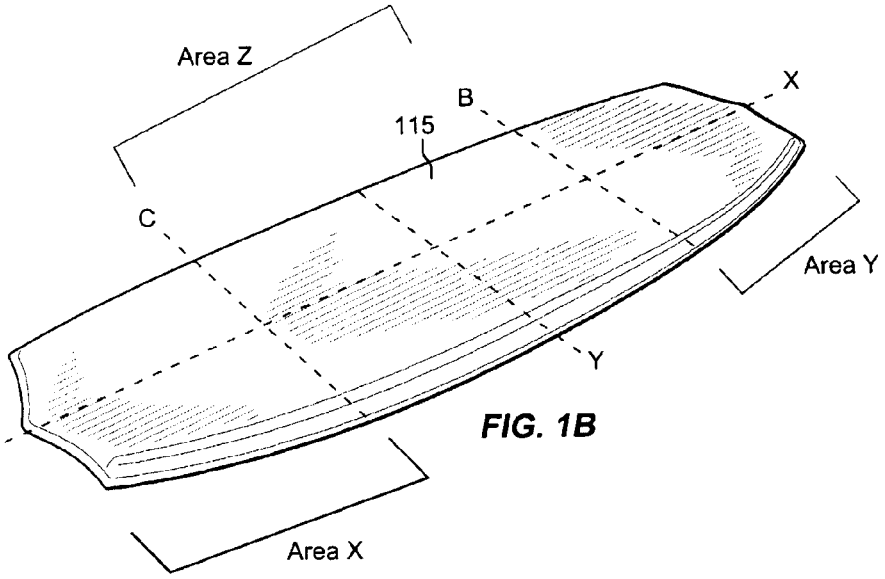

FIGS. 1A and 1B depicts a top view and an isometric view, respectively, of surfboard 101. In various embodiments, surfboard 101 is substantially symmetrical across the center Y axis. Additionally, surfboard is substantially symmetrical across the longitudinal X axis. As will be described in further detail below, surfboard 101 is able to be ridden either direction creating a dual directional experience. For example first end 110 could act as the leading end (nose) while second end 111 acts as the trailing end (tail), or vise-versa. In one embodiment, first end 110 and second end 111 can be the same end shape. For example, first end and second end could both be pintail, fish tail, moon tail, batwing, asymmetrical variation or any other known tail design or nose design. In various embodiments, end 110 can be different then end 111.

Figure 4A:
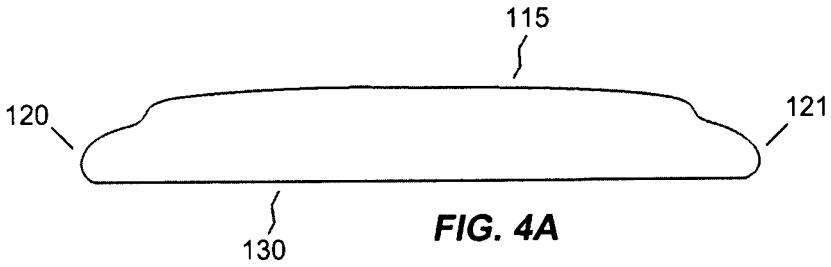
Figure 4B:
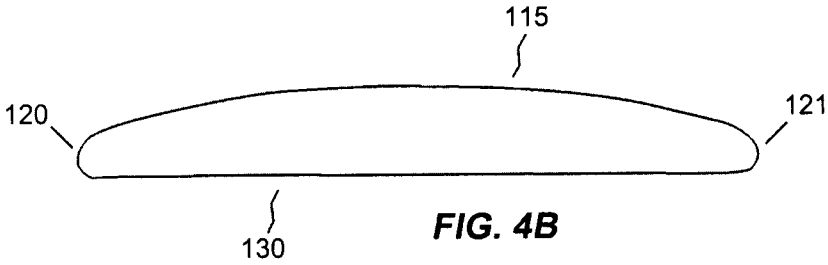
Figure 5:
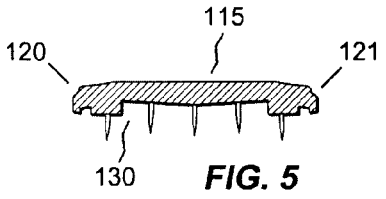

Surfboard 101 includes top deck 115, first rail 120 and second rail 121. Rails 120 and 121 can be continuous standard curve from top deck 115, as seen in FIG. 4B, or can be a step down from top deck 115, as depicted in FIG. 4A which are both a cross section view around Y axis. Step down deck allows surfboard 101 to be thicker, to allow for increased buoyancy, while rails 120 and 121 maintain a thinner profile allowing for more high performance edges. Rails may be hard (sharp) or soft (rounded) along the entire length of the rail, or may transition between the hard and soft in various sections. For example, FIG. 5 depicts a cross-sectional view, along line B, of a hard edge. Hard rails may be used as gripping traction in the water like that of surfboard fins. Thickness and shape of the rails may vary throughout the length of the board rails. Top deck 115 may also incorporate foot-retaining features 710 and 712, as depicted in FIG. 7. Length of surfboard 101 can be various lengths. However, it can be shorter than conventional surfboards due to its features described herein. In one embodiment, surfboard 101 is on or around 5 feet in length, on or around 20 inches in width at Y axis, on or around 2.25 inches thick at the center of top deck 115 to bottom surface 130, and rails 120 and 121 are 1.5 inches thick at the Y axis. Surfboard 101 can be any buoyant watercraft with any use. Surfboard 101 can be made through various methods (e.g., hand crafted, machine made or any combination of the two), and can be created with any material or combination of materials. In one embodiment surfboard 101 is made of foam and glass, but other materials/methods may be applied.

In one embodiment surfboard 101 is utilized in a body of water and is propelled by wave energy. In various examples a naturally occurring wave or in a man made wave in a wave park.

Figure 2A:
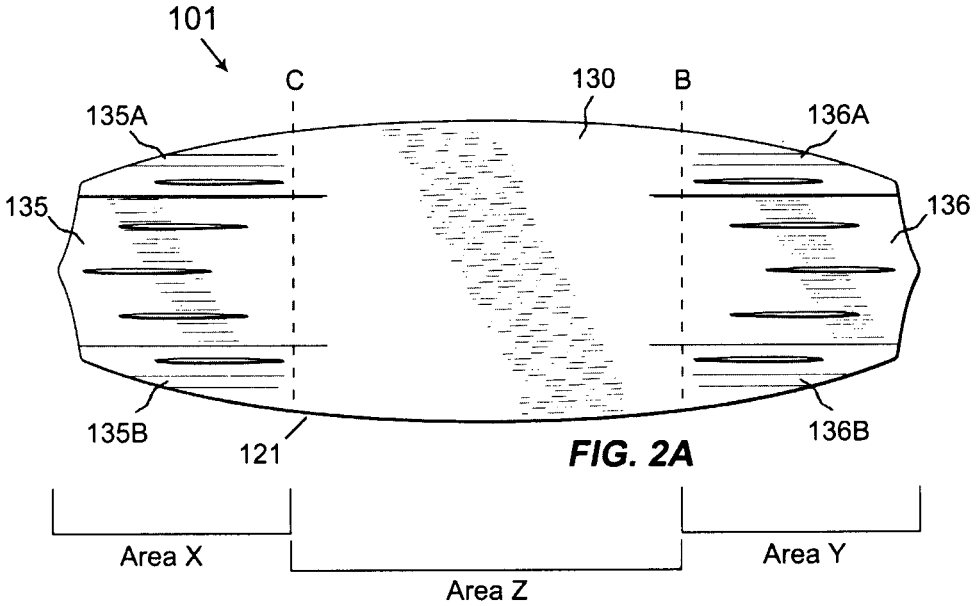

FIG. 2A depicts a bottom view of an embodiment of surfboard 101. Bottom deck 130 of surfboard 101 can be an unbroken smooth surface or may include ridges known as channels as seen in at least FIG. 2A and FIG. 2B. Bottom deck 130 can have no channels, one channel, or multiple channels in any combination within Areas X, Y, and Z. Bottom deck 130 may also have any combination of fins in both number and shape, as well as be absent of fins. For example, bottom deck 130 does not include fins in Area X and Area Y. Channels and/or fins may be symmetrical, asymmetrical, or non-symmetrical with one another.

FIG. 2A depicts bottom deck 130 with main center channels 135 and 136, and outer channels 135A, 135B, 136A, and 136B. Channels help increase flow of water and/or gripping traction in water like that of a fin. Channel may run through the length of surfboard, but as depicted, both channel 135 and channel 136 transition to a flat area in the center section of Area Z of bottom deck 130. In another embodiment, there may be no channels or other combinations of channels on bottom deck 130.

Figure 2B:
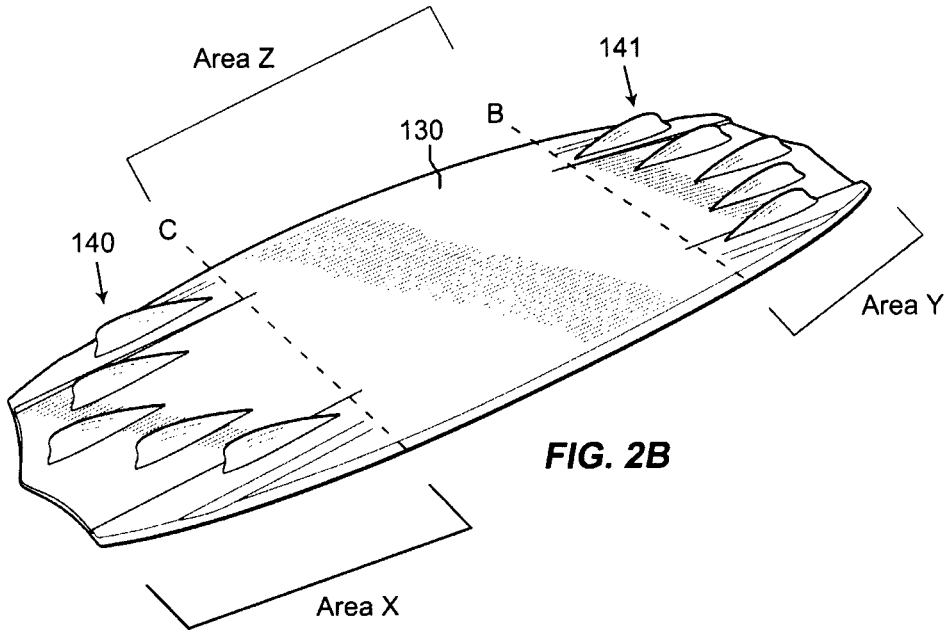

FIG. 2B depicts fins 140 located in Area X and fins 141 in Area Y. Fins 140 and/or 141 may be in any number or shape combination and at times may bleed into Area Z. Fins can be in any pattern or orientation that allows for bi-directional use. As used herein bi-directional refers to surfboard 101 being able to be propelled in either direction (either the tail or the nose acting as either the leading or trailing end). Fins may be symmetrical or asymmetrical, for example, as depicted in FIG. 8B and 8B, as well as have any formation of fins on either end. Areas X and Y are generally separated by lines C and B, which define end transitional areas that may include a rocker to compensate for fin height in order to keep whichever set of fins are out of water while acting as current front (nose) of surfboard 101. For example when first end 110 is acting as the tail, then first end 110 is primarily in the water while second end 111 is out of the water as acting as the nose. In contrast when second end 111 is acting as the tail, then second end 111 is primarily in the water while first end 110 is out of the water as acting as the nose.

Figure 3:
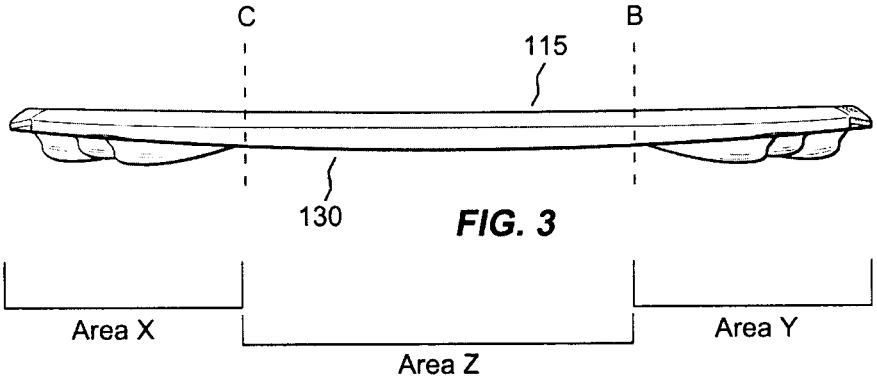

FIG. 3 depicts side view of surfboard 101. As depicted is a three-stage-rocker with the Area Z between lines C and B being substantially flat with Areas X and Y having respective rocker curve. In various embodiments, it could be one continuous rocker curve from end to end, a flat rocker, or any combination thereof. Area Z brings a center focus to surfboard 101. In one embodiment, the center focus allows for the typical planing surface to be at the center allowing for dual direction and symmetrical feet placement.

FIG. 4A depicts center cross section from Y axis. FIG. 4A depicts an embodiment of a step down deck where there is a difference in thickness created between top deck 115 and rails 120 and 121. FIG. 4B depicts a cross-sectional view along Y axis of another embodiment of a continuous top deck 115 transitioning into rails 120 and 121.

FIG. 5 is a cross-sectional view along line B of FIG. 1A and shows the transition of the progressive rail, in particular a transition from a soft center rail to a hard end rail. Transitional progressive rails allow for a smooth center rail ride while maintaining hard rails with greater water grip to add traction as the rails transition towards the ends of the board.

Figure 6:
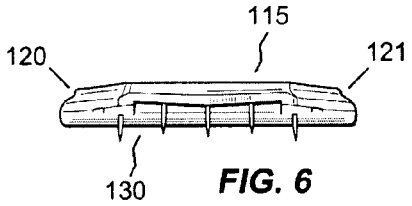

FIG. 6 depicts end view of surfboard 101 showing one side of channels, fins, rails, and step down deck. FIG. 6 also highlights the low profile of the fins as they relate to rocker, as described above.

Figure 7A:
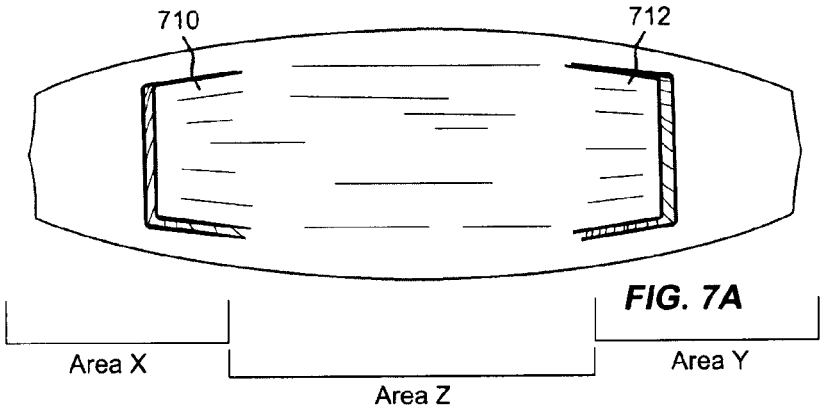
Figure 7B:
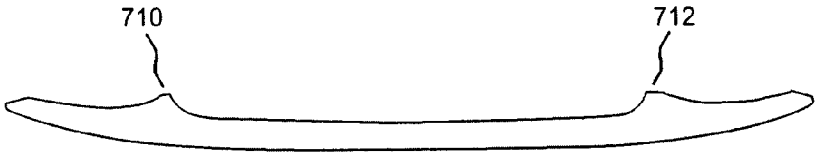

FIG. 7A depicts a top view and FIG. 7B depicts a side view of an embodiment of surfboard 101 depicting foot features 710 and 712. Foot features 710 and 712 allow for increased leverage, lift, consistent foot placement, and/or traction. Foot features may be shaped into the board or added as attachments. Foot features can be inset or protruding. Whether or not there are foot features, surfboard 101 does not require foot straps or bindings that retain the feet on the board.

Shorter length of surfboard 101 allows shoulder width stance utilizing feet position with foot features as described with reference to fins 140 and 141.

Figure 8A:
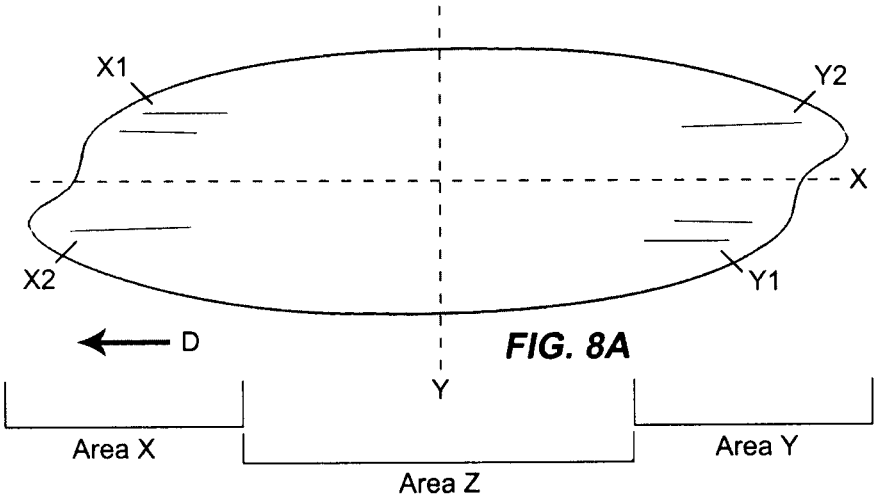
Figure 8B:
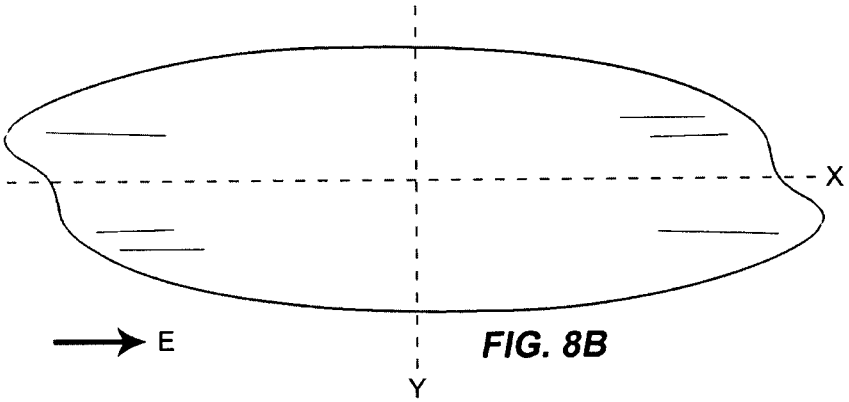

FIG. 8A depicts an embodiment of a dual asymmetrical shape. Asymmetrical shape is a flip mirror image with respect to both longitudinal (X axis) and latitudinal lines (Y axis). FIG. 8B depicts the opposite embodiment as depicted in FIG. 8A.

FIG. 8A depicts Area X with multi-fin area X1 combination with single fin area X2. Area X and Area Y are asymmetrically flipped (along the X axis and Y axis) allowing for Area Y to include areas Y2 and Y1. FIG. 8A fin areas allow, when going in the direction D, as depicted by the arrow, as the current wave direction, an end with one fin area out of the water as depicted in Area X2 acting as the nose of the board and Area Y1 acting as the tail of the board with 2 fins for greater traction. When switching board direction, Area X1 becomes tail of surfboard and Area Y2 becomes the nose. These terms can become interchangeable depending on a riders' orientation. The surfboard depicted in FIG. 8B can be applied in same manor but with the opposite orientation, indicated by direction E, to begin with.

Figure 9:
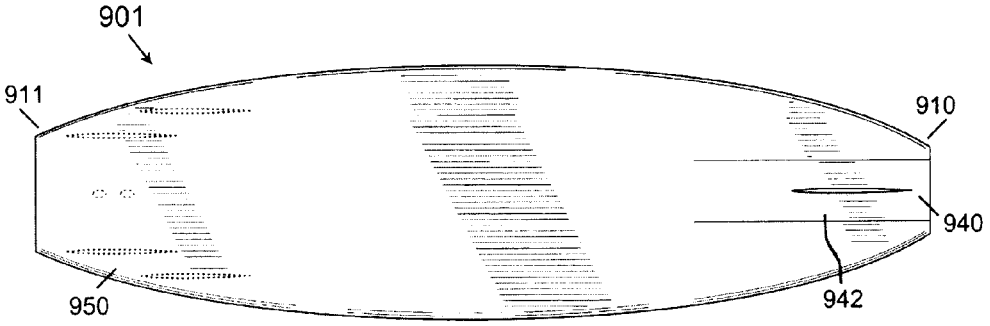

FIG. 9 depicts an embodiment of surfboard 901. Surfboard 901 includes first end 910 and second end 911. In one embodiment first end 910 includes fin 940 disposed in channel 942. In another embodiment second end 911 includes a plurality of fins 950. Fins 950 can be disposed in a channel or not in a channel or any combination there of.

Figure 10:
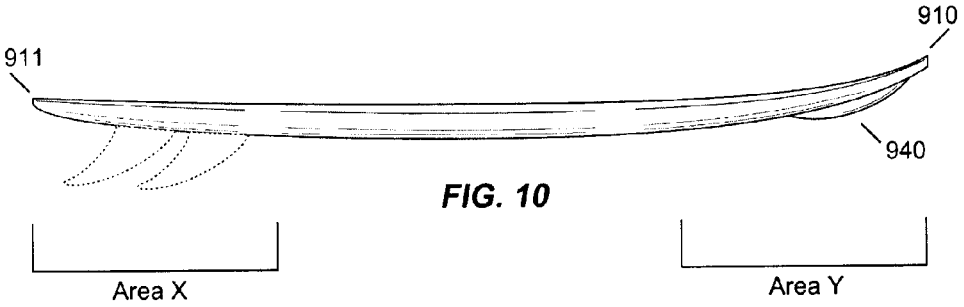

FIG. 10 depicts a side view of an embodiment of surfboard 901. Surfboard 901 includes a rocker in the region of the front end 910 as depicted by Area Y as opposed to less of a rocker in Area X.

Figure 11:
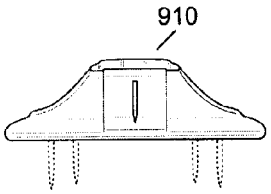
Figure 12:
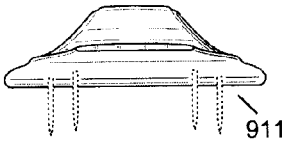

FIG. 11 depicts an end view looking at first end 910. FIG. 12 depicts an end view looking at second end 911.

Figure 13A:
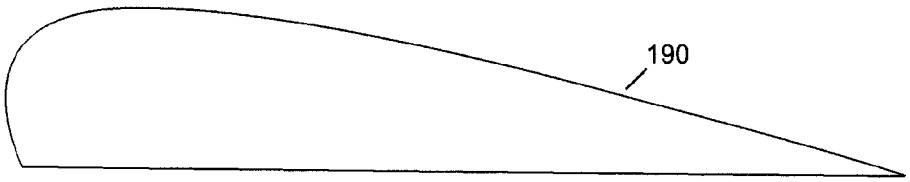
FIG. 13A-13C illustrates an embodiment of fins.
Figure 13B:
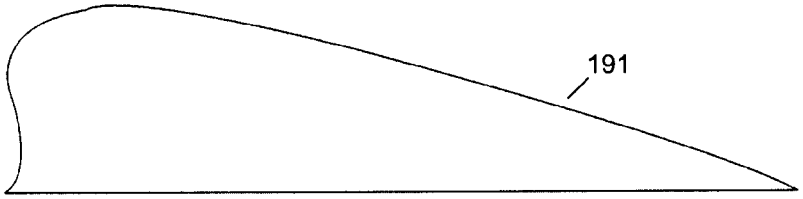
Figure 13C:
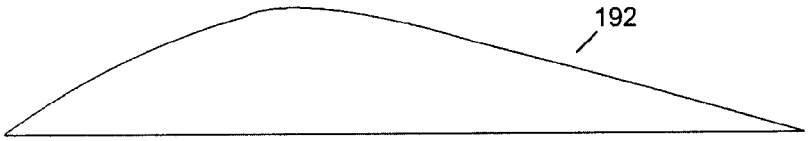

FIG. 13A-13C depicts embodiments of low profile fin 190, 191, and 192 respectively. Low profile fins allow for the surface area of the fin to be stretched horizontally reducing the height (rake) of the traditional surfboard fin. The reduced height of the fins allow for greatly reduced drag or interference from fins when they are on the front of surfboard 101, 901 or any of its embodiments. Low profile fins can be any shape or variation as it pertains to its unique features. Low profile fins can be in any combination with any fins.

It should be appreciated that embodiments, as described herein, can be utilized or implemented alone or in combination with one another. While the present invention has been described in particular embodiments, it should be appreciated that the present invention should not be construed as limited by such embodiments, but rather construed according to the following claims.

The invention claimed is:

1. A dual-directional surfboard apparatus for use on the surface of a body of water and propelled by wave energy comprising:

a first end;

a second end such that either of said first end or said second end acts as a tail;

a first end rail edge extending along first outer edge of said first end of said dual-directional surfboard;

a second end rail edge extending along second outer edge of said second end of said dual-directional surfboard;

a first side rail extending along a first outer edge of said dual-directional surfboard, wherein said first side rail is longer than either end rail;

a second side rail extending along a second opposite outer edge of said dual-directional surfboard, wherein said second side rail is longer than either end rail;

a latitudinal center Y-axis between said first end and said second end orthogonally bisecting said first side rail and said second side rail;

a first latitudinal C-axis one third in from the said first end;

a second latitudinal B-axis one third in from the said second end;

a center longitudinal X-axis extending between said first side rail and said second side rail bisecting said first end rail edge and said second end rail edge;

a top surface, such that a rider may be positioned on the top surface;

a bottom surface such that it makes contact with water surface, wherein said bottom surface is planar extending between said first side rail and said second side rail parallel to said center Y-axis, wherein said dual-directional surfboard is configured to seat a plurality of fins such that said plurality of fins protrudes only from said bottom surface, wherein each of said plurality of fins protrudes orthogonally with respect to said bottom surface, wherein each of said fins running parallel with respect to said X-axis has a low profile elongated base length that is greater than said fins height measured from the said bottom surface of the surfboard to the tallest point of said fins, wherein each said elongated fin has a general linear surface along its chord length moving from the base of the said fin to the outer said fin tip edge, wherein each of said fins resides in a flow channel which directs the flow of water each having a length greater than its height;

a equally divided three stage rocker curvature in the longitudinal contour of the said dual-directional surfboard defined by said B-axis and said C-axis comprising a center Area-Z, a first end Area-X, and a second end Area-Y, wherein said center sectional Area-Z is between said C-axis and said B-axis, wherein Area-Z is substantially neutral in respect to said three stage rocker curvature, wherein said Area-X and said Area-Y gradually deviates from said center Area-Z increasing in rocker curvature away from waters surface from said C-axis towards said first end and said B-axis towards said second end, wherein said Area-X and said Area-Y contain said low profile fins and said channels;

a first directional orientation, wherein a rider has some foot contact with said top surface of said dual-directional surfboard, wherein said first end is the trailing back end and said second end is the leading front end established by forward motion relative between the said bottom surface and the water moving beneath it;

a second directional orientation, wherein a rider has some foot contact with said top surface of said dual-directional surfboard, wherein said second end is the trailing back end and said first end is the leading front end established by forward motion relative between the said bottom surface and the water moving beneath it;

a first contact section comprised of both said end Area-X and said middle Area-Z, wherein said first directional orientation is in use, wherein the said first contact section sits on and is engaged with the surface of the water, wherein the opposing said Area-Y is out of the water due to riders said first directional orientation and said Area-Y rocker curvature, wherein said Area-Y rocker and said low profile fins and said channels correlate in said rocker pitch and said fin height to reduce possibility of unintentional said fin interference with water surface; and a second opposing contact section comprised of both said end Area-Y and said middle Area-Z, wherein said second directional orientation is in use, wherein the said second contact section sits on and is engaged with the surface of the water, wherein the opposing said Area-X is out of the water due to riders said second directional orientation and said Area-X rocker curvature, wherein said Area-X rocker and said low profile fins and said channels correlate in said rocker pitch and said fin height to reduce possibility of unintentional said fin interference with water surface.

2. The dual-directional surfboard of claim 1, wherein said bottom surface of said first end Area-X and said second end Area-Y both includes at least one of said plurality of fins.

3. The dual-directional surfboard of claim 2, wherein said first end rail edge and said second end rail edge as seen from a bird's-eye view of said top or bottom surfaces are the same symmetrical profile in respect to the said Y-axis.

4. The dual-directional surfboard of claim 3, wherein said bottom surface of said first end Area-X comprises only a single center said elongated low profile fin.

5. The dual-directional surfboard of claim 4, wherein said second end Area-Y comprises more than one said elongated low profile fins.

6. The dual-directional surfboard of claim 4, wherein said second end Area-Y comprises only a single center said elongated fin.

7. The dual-directional surfboard of claim 3, wherein said first end Area-X comprises more than one said elongated fin and said second end Area-Y comprises more than one said elongate low profile fins.

8. The dual-directional surfboard of claim 1, wherein said first end rail edge and corresponding said first and second side rail edges within said Area-X are a different profile than said second end rail edge and corresponding said first and second side rail edges within said Area-Y as seen from a bird's-eye view of said top or bottom surfaces with respect to symmetry of said Y-axis, wherein said edges are symmetrical as seen from a bird's-eye view of said top or bottom surfaces in respect to the said X-axis.

9. The dual-directional surfboard of claim 8, wherein said bottom surface of said second end Area-Y comprises only a single center said elongated low profile fin.

10. The dual-directional surfboard of claim 9, wherein said bottom surface of said first end Area-X comprises more than one said elongated low profile fins.

11. The dual-directional surfboard of claim 9, wherein said bottom surface of said first end Area-X comprises only a single center said elongated fin.

12. The dual-directional surfboard of claim 8, wherein said bottom surface of said first end Area-X comprises more than one said elongated low profile fins and said bottom surface of said second end Area-Y comprises more than one said elongate low profile fins.

13. The dual-directional surfboard of claim 2, wherein said bottom surface of said first end Area-X comprises multiple said fins disposed in at least one said channel.

14. The dual-directional surfboard of claim 13, wherein said bottom surface of said second end Area-Y comprises at least a subset of said plurality of fins disposed in a second opposing said channel.

15. The dual-directional surfboard of claim 2, wherein said first end Area-X said rails and said second end Area-Y said rails are asymmetrical with respect to said Y-axis and said X-axis, wherein the said first end edge profile is asymmetrical in respect to the said X-axis but the opposing said second end edge profile is a mirrored inverse in respect to the said X-axis and said Y-axis.

16. The dual-directional surfboard of claim 1, wherein at least one of said first end Area-X or said second end Area-Y comprises multiple said channels on said bottom surface.

17. The dual-directional surfboard of claim 1, wherein said top surface of said dual directional surfboard does not require foot bindings, wherein rider is not fastened to said top or bottom surfaces.

18. The dual-directional surfboard of claim 3, wherein said bottom surfaces of said first end Area-X and said second end Area-Y each comprise five said elongated low profile fins.

19. The dual-directional surfboard of claim 2, wherein said first end rail edge and said second end rail edge as seen from a bird's-eye view of said top or bottom surfaces exhibit a different profile, wherein said first and second side rail edges within said Area-X and said first and second side rail edges within said Area-Y as seen from a bird's-eye view of said top or bottom surfaces comprise the same symmetrical profile.

20. The dual-directional surfboard of claim 2, wherein said top surface of said dual directional surfboard comprises foot pads, wherein a first said foot pad is located in the general area of said first longitudinal B-axis and protrude from said top surface at an increasing slope towards said second end and a second said foot pad is located in the general area of said second longitudinal C-axis and protrudes from said top surface at an increasing slope towards said first end, wherein no attachment is made between rider and said top or bottom board surface.

* * * * *